US011009238B2

(12) United States Patent
Neal

(10) Patent No.: US 11,009,238 B2
(45) Date of Patent: May 18, 2021

(54) STAGED OVEN SELF-CLEAN PREHEAT TEMPERATURE CONTROL

(71) Applicant: Midea Group Co., Ltd., Foshan (CN)

(72) Inventor: Vern A. Neal, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 146 days.

(21) Appl. No.: 16/290,154

(22) Filed: Mar. 1, 2019

(65) Prior Publication Data

US 2020/0278120 A1 Sep. 3, 2020

(51) Int. Cl.

| | |
|---|---|
| ***F24D 19/10*** | (2006.01) |
| ***F24C 14/02*** | (2006.01) |
| ***F24C 3/12*** | (2006.01) |
| ***F24F 11/49*** | (2018.01) |
| *F24F 110/10* | (2018.01) |

(52) U.S. Cl.
CPC ..... *F24D 19/1084* (2013.01); *F24C 3/128* (2013.01); *F24C 14/02* (2013.01); *F24F 11/49* (2018.01); *F24F 2110/10* (2018.01)

(58) Field of Classification Search
CPC ..... F24C 3/128; F24C 14/02; F24D 19/1084; F24F 11/49; F24F 2110/10
USPC ..... 219/448.11, 448.15, 710, 441
See application file for complete search history.

(56) References Cited

U.S. PATENT DOCUMENTS

| | | | | |
|---|---|---|---|---|
| 1,671,194 A | | 5/1928 | Koppers | |
| 3,303,326 A | | 2/1967 | Holtkamp | |
| 3,786,161 A | | 1/1974 | Sartorius | |
| 4,134,005 A | | 1/1979 | Eppens | |
| 4,292,501 A | * | 9/1981 | Maitenaz | F24C 14/02 219/413 |
| 4,493,976 A | | 1/1985 | Wilson | |
| 4,742,246 A | | 5/1988 | Mori | |
| 4,774,685 A | * | 9/1988 | Samuels | G06F 17/17 708/270 |
| 4,904,849 A | | 2/1990 | Sinn | |
| 5,120,916 A | | 6/1992 | Horinouchi et al. | |
| 5,438,180 A | | 8/1995 | Eisenbrandt et al. | |
| 5,575,194 A | | 11/1996 | Maher, Jr. et al. | |
| 5,711,606 A | | 1/1998 | Koether | |
| 5,971,249 A | | 10/1999 | Berkin | |

(Continued)

FOREIGN PATENT DOCUMENTS

| | | |
|---|---|---|
| CA | 2780668 A1 | 11/2013 |
| CN | 1517591 A | 8/2004 |

(Continued)

OTHER PUBLICATIONS

U.S. Patent Office; Office Action issued in U.S. Appl. No. 16/290,160 dated Jul. 13, 2020.

(Continued)

*Primary Examiner* — Jianying C Atkisson
*Assistant Examiner* — Meraj A Shaikh
(74) *Attorney, Agent, or Firm* — Middleton Reutlinger

(57) ABSTRACT

One or more cooking elements of a cooking appliance may be controlled during the preheat phase of an oven self-clean cycle to maintain a temperature within an oven cavity proximate an intermediate temperature setpoint that is below a self-clean temperature setpoint for the oven self-clean cycle until reaching a predetermined time in the oven self-clean cycle.

19 Claims, 5 Drawing Sheets

(56) References Cited

U.S. PATENT DOCUMENTS

| | | | | |
|---|---|---|---|---|
| 6,201,222 | B1 * | 3/2001 | Baker | F24C 7/087 219/412 |
| 6,316,749 | B1 * | 11/2001 | Bales | F24C 14/02 219/396 |
| 6,381,518 | B1 | 4/2002 | Huffington et al. | |
| 6,987,252 | B2 | 1/2006 | Graves et al. | |
| 7,094,996 | B2 | 8/2006 | Boehm | |
| 7,368,685 | B2 | 5/2008 | Nam et al. | |
| 7,420,145 | B2 | 9/2008 | Kim | |
| 7,750,271 | B2 | 7/2010 | Smith et al. | |
| 7,964,824 | B2 | 6/2011 | Moon | |
| 8,269,151 | B2 | 9/2012 | Klasmeier et al. | |
| 8,552,344 | B2 | 10/2013 | Bonassi et al. | |
| 8,796,590 | B2 | 8/2014 | Boyer et al. | |
| 9,815,191 | B2 | 11/2017 | Oleynik | |
| 9,927,128 | B2 | 3/2018 | Boedicker | |
| 9,946,273 | B2 | 4/2018 | Kusukame et al. | |
| 10,024,544 | B2 | 7/2018 | Bhogal et al. | |
| 2002/0023911 | A1 | 2/2002 | Bales et al. | |
| 2008/0264269 | A1 | 10/2008 | Sterzel et al. | |
| 2011/0139141 | A1 * | 6/2011 | Shaffer | C23C 30/00 126/273 R |
| 2013/0269539 | A1 | 10/2013 | Polt | |
| 2015/0330640 | A1 | 11/2015 | Wersborg | |
| 2017/0276375 | A1 * | 9/2017 | Johnson | F24C 7/085 |
| 2018/0220500 | A1 | 8/2018 | Staton et al. | |

FOREIGN PATENT DOCUMENTS

| | | | | |
|---|---|---|---|---|
| CN | 106901615 | A | 6/2017 | |
| CN | 108903683 | A | 11/2018 | |
| DE | 102016219758 | B3 | 4/2018 | |
| EP | 0537796 | A2 * | 4/1993 | F24C 14/02 |
| EP | 0537796 | A2 | 4/1993 | |
| EP | 0735449 | A1 | 10/1996 | |
| EP | 2123981 | A1 | 11/2009 | |
| EP | 2993410 | A1 | 3/2016 | |
| EP | 3001163 | A1 | 3/2016 | |
| GB | 1348611 | A | 3/1974 | |
| GB | 2516610 | A | 2/2015 | |
| WO | WO2018148363 | A1 | 8/2018 | |

OTHER PUBLICATIONS

International Search Report and Written Opinion in Application No. PCT/CN2019/121698, dated Feb. 28, 2020.

International Search Report and Written Opinion in PCT Application No. PCT/CN2019/117042 dated Feb. 19, 2020.

Electrolux, Built-In Wall Oven: Manual, Electrolux Home Products, Inc., 2007.

Bosch, Built-In Ovens: Use and Care Manual, BSH Home Appliances Corporation, 2007.

Babyak, Richard, Fast and Flexible: customizable design speeds development of user-friendly, commercial appliance control systems, Appliance Manufacturer 517.7: 36(5). BNP Media, Jul. 2003.

Transmittal of Related Applications.

U.S. Patent Office; Notice of Allowance issued in U.S. Appl. No. 16/290,160 dated Nov. 4, 2020.

* cited by examiner

STAGED OVEN SELF-CLEAN PREHEAT TEMPERATURE CONTROL

BACKGROUND

Consumer appliances generally require certification by regulatory authorities in many countries prior to sale in those countries. Appliance manufacturers often desire to offer a wide range of products to consumers, and as a result, manufacturers often expend significant resources obtaining certification for their products. Some countries, however, do allow for certain tests to be waived for products seeking certification should those products being evaluated be constructed and operate in a manner similar to an existing certified product.

For cooking appliances including ovens, such as ranges and wall-mounted ovens, for example, certain tests may be waived based upon a comparison of "time-temperature" curves of an existing certified product and a product being evaluated. A time-temperature curve, for example, may be generated by measuring the air temperature within an oven cavity as the oven is preheated during a self-clean cycle, since the self-clean cycle is generally designed to hold a temperature within the oven cavity that is close to the maximum possible oven temperature (given limitations in heating power and in minimizing heat losses).

Two products may be considered to be sufficiently similar when the times to reach certain temperatures are within certain ranges. However, it has been found that for various reasons, including manufacturing variations in cooking elements, even two products having essentially the same construction and essentially the same control may fail the time-temperature curve comparisons, and thus necessitate full testing prior to certification for products that are substantially similar to other previously certified products.

SUMMARY

The herein-described embodiments address these and other problems associated with the art by controlling one or more cooking elements of a cooking appliance during the preheat phase of an oven self-clean cycle to maintain a temperature within an oven cavity proximate an intermediate temperature setpoint that is below a self-clean temperature setpoint for the oven self-clean cycle until reaching a predetermined time in the oven self-clean cycle. By doing so, the time-temperature curve of a cooking appliance may be more carefully controlled, e.g., to provide a substantially consistent time-temperature curve that is more resistant to manufacturing variations in cooking elements and the like.

Therefore, consistent with one aspect of the invention, a cooking appliance may include a housing including an oven cavity, a temperature sensor configured to sense an air temperature within the oven cavity, one or more electric cooking elements configured to generate heat within the oven cavity, and a controller in communication with the temperature sensor and configured to control the one or more electric cooking elements to perform an oven self-clean cycle within the oven cavity. The controller may be configured to perform the oven self-clean cycle by regulating the one or more electric cooking elements to maintain the temperature within the oven cavity proximate a self-clean temperature setpoint, and the controller may be further configured to perform the oven self-clean cycle by, during a preheat phase of the oven self-clean cycle, regulating the one or more cooking elements to increase the air temperature within the oven cavity to a first intermediate temperature setpoint that is below about 316° C. (about 600° F.), thereafter regulating the one or more electric cooking elements to maintain the air temperature within the oven cavity proximate the first intermediate temperature setpoint until reaching a first predetermined time, thereafter regulating the one or more cooking elements to increase the air temperature within the oven cavity to a second intermediate temperature setpoint that is above about 316° C. (about 600° F.) and below about 454° C. (about 850° F.), thereafter regulating the one or more electric cooking elements to maintain the air temperature within the oven cavity proximate the second intermediate temperature setpoint until reaching a second predetermined time, and thereafter regulating the one or more cooking elements to increase the air temperature within the oven cavity to the self-clean temperature setpoint. In addition, the controller may regulate the one or more electric cooking elements to provide a controlled rise time to the self-clean temperature setpoint that is substantially independent of any variance in output power of the one or more electric cooking elements.

Consistent with another aspect of the invention, a cooking appliance may include a housing including an oven cavity, a temperature sensor configured to sense a temperature within the oven cavity, one or more cooking elements configured to generate heat within the oven cavity, and a controller in communication with the temperature sensor and configured to control the one or more cooking elements to perform an oven self-clean cycle within the oven cavity. The controller may be configured to perform the oven self-clean cycle by regulating the one or more cooking elements to maintain the temperature within the oven cavity proximate a self-clean temperature setpoint, and the controller may be further configured to perform the oven self-clean cycle by, during a preheat phase of the oven self-clean cycle, regulating the one or more cooking elements to maintain the temperature within the oven cavity proximate an intermediate temperature setpoint that is below the self-clean temperature setpoint until reaching a predetermined time in the oven self-clean cycle.

Also, in some embodiments, the controller is further configured to, after reaching the predetermined time, regulate the one or more cooking elements to increase the temperature within the oven cavity to the self-clean temperature setpoint and initiate a clean phase of the oven self-clean cycle. Moreover, in some embodiments, the intermediate temperature setpoint is a first intermediate temperature setpoint and the predetermined time is a first predetermined time, and the controller is further configured to, after reaching the first predetermined time, regulate the one or more cooking elements to maintain the temperature within the oven cavity proximate a second intermediate temperature setpoint that is above the first intermediate temperature setpoint and below the self-clean temperature setpoint until reaching a second predetermined time in the oven self-clean cycle.

Further, in some embodiments, the self-clean temperature setpoint is associated with a first test waiver target temperature, the first intermediate temperature setpoint is below a second test waiver target temperature, and the first test waiver target temperature is above the second test waiver target temperature. Also, in some embodiments, the controller is configured to control the one or more cooking elements during the preheat phase to provide a controlled rise time from the second test waiver target temperature to the first test waiver target temperature that is substantially independent of any variance in output power of the one or more cooking elements. Further, in some embodiments, the controller is further configured to control the one or more cooking elements during the preheat phase to provide a controlled rise time from room temperature to the first test waiver target temperature that is substantially independent of any variance in output power of the one or more cooking elements. In some embodiments, the first test waiver target temperature is the lesser of about 454° C. (about 850° F.) and a maximum oven cavity air temperature, and where the second test waiver target temperature is about 316° C. (about 600° F.).

Also, in some embodiments, the controller is configured to regulate the one or more cooking elements during the preheat phase to increase the temperature within the oven cavity to the intermediate temperature setpoint prior to maintaining the temperature within the oven cavity proximate the intermediate temperature setpoint and prior to reaching the predetermined time in the oven self-clean cycle. In some embodiments, the one or more cooking elements includes one or more electric cooking elements, and the controller is configured to regulate the one or more cooking elements to maintain the temperature within the oven cavity proximate the intermediate temperature setpoint by cycling the one or more electric cooking elements between active and inactive states.

Consistent with another aspect of the invention, a method of controlling a cooking appliance may include sensing a temperature within an oven cavity of a cooking appliance, with a controller in communication with the temperature sensor, performing an oven self-clean cycle within the oven cavity by regulating one or more cooking elements that generate heat within the oven cavity to maintain the temperature within the oven cavity proximate a self-clean temperature setpoint, and with the controller and during a preheat phase of the oven self-clean cycle, regulating the one or more cooking elements to maintain the temperature within the oven cavity proximate an intermediate temperature setpoint that is below the self-clean temperature setpoint until reaching a predetermined time in the oven self-clean cycle.

Some embodiments may also include, after reaching the predetermined time, regulating the one or more cooking elements to increase the temperature within the oven cavity to the self-clean temperature setpoint and initiating a clean phase of the oven self-clean cycle. Further, in some embodiments, the intermediate temperature setpoint is a first intermediate temperature setpoint and the predetermined time is a first predetermined time, and the method further includes, after reaching the first predetermined time, regulating the one or more cooking elements to maintain the temperature within the oven cavity proximate a second intermediate temperature setpoint that is above the first intermediate temperature setpoint and below the self-clean temperature setpoint until reaching a second predetermined time in the oven self-clean cycle.

In some embodiments, the self-clean temperature setpoint is associated with a first test waiver target temperature, the first intermediate temperature setpoint is below a second test waiver target temperature, and the first test waiver target temperature is above the second test waiver target temperature. Some embodiments may also include controlling the one or more cooking elements during the preheat phase to provide a controlled rise time from the second test waiver target temperature to the first test waiver target temperature that is substantially independent of any variance in output power of the one or more cooking elements. Some embodiments may further include controlling the one or more cooking elements during the preheat phase to provide a controlled rise time from room temperature to the first test waiver target temperature that is substantially independent of any variance in output power of the one or more cooking elements. Also, in some embodiments, the first test waiver target temperature is the lesser of about 454° C. (about 850° F.) and a maximum oven cavity air temperature, and where the second test waiver target temperature is about 316° C. (about 600° F.).

In addition, some embodiments may also include regulating the one or more cooking elements during the preheat phase to increase the temperature within the oven cavity to the intermediate temperature setpoint prior to maintaining the temperature within the oven cavity proximate the intermediate temperature setpoint and prior to reaching the predetermined time in the oven self-clean cycle. In addition, in some embodiments, the one or more cooking elements includes one or more electric cooking elements, and regulating the one or more cooking elements to maintain the temperature within the oven cavity proximate the intermediate temperature setpoint includes cycling the one or more electric cooking elements between active and inactive states.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
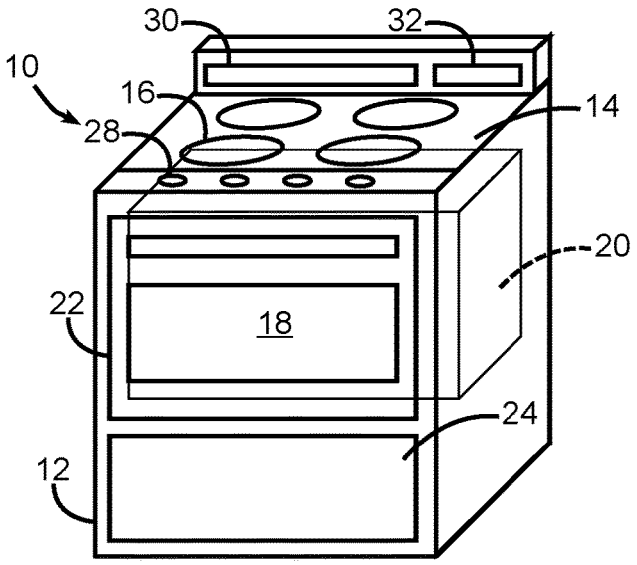
FIG. 1 is a perspective view of a cooking appliance consistent with some embodiments of the invention.

Turning now to the drawings, wherein like numbers denote like parts throughout the several views, FIG. 1 illustrates an example cooking appliance 10 in which the various technologies and techniques described herein may be implemented. Cooking appliance 10 is a residential-type range, and as such includes a housing 12, a stovetop or cooktop 14 including a plurality of burners 16, and an oven 18 defining an oven or cooking cavity 20 accessed via an oven door 22. Cooking appliance 10 may also include a storage drawer 24 in some embodiments, or in other embodiments, may include a second oven. Various cooking elements (not shown in FIG. 1) may also be incorporated into cooking appliance 10 for cooking food in oven 18, e.g., one or more electric or gas heating elements.

Cooking appliance 10 may also include various user interface devices, including, for example, control knobs 28 for controlling burners 16, a control panel 30 for controlling oven 18 and/or burners 16, and a display 32 for providing visual feedback as to the activation state of the cooking appliance. It will be appreciated that cooking appliance 10 may include various types of user controls in other embodiments, including various combinations of switches, buttons, knobs and/or sliders, typically disposed at the rear or front (or both) of the cooking appliance. Further, in some embodiments, one or more touch screens may be employed for interaction with a user. As such, in some embodiments, display 32 may be touch sensitive to receive user input in addition to displaying status information and/or otherwise interacting with a user. In still other embodiments, cooking appliance 10 may be controllable remotely, e.g., via a smartphone, tablet, personal digital assistant or other networked computing device, e.g., using a web interface or a dedicated app.

Display 32 may also vary in different embodiments, and may include individual indicators, segmented alphanumeric displays, and/or dot matrix displays, and may be based on various types of display technologies, including LEDs, vacuum fluorescent displays, incandescent lights, etc. Further, in some embodiments audio feedback may be provided to a user via one or more speakers, and in some embodiments, user input may be received via a spoken or gesture-based interface.

As noted above, cooking appliance 10 of FIG. 1 is a range, which combines both a stovetop and one or more ovens, and which in some embodiments may be a standalone or drop-in type of range. In other embodiments, however, cooking appliance 10 may be another type of cooking appliance, e.g., a wall mount or freestanding oven. In general, a cooking appliance consistent with the invention may be considered to include any residential-type appliance including a housing and one or more cooking elements disposed therein and configured to generate energy for cooking food within one or more oven cavities.

In turn, a cooking element may be considered to include practically any type of energy-producing element used in residential applications in connection with cooking food, e.g., employing various cooking technologies such as electric, gas, light, microwaves, induction, convection, radiation, etc. In the case of an oven, for example, one or more cooking elements therein may be gas, electric, light, or microwave heating elements in some embodiments, while in the case of a stovetop, one or more cooking elements therein may be gas, electric, or inductive heating elements in some embodiments. Further, it will be appreciated that any number of cooking elements may be provided in a cooking appliance (including multiple cooking elements for performing different types of cooking cycles such as baking or broiling), and that multiple types of cooking elements may be combined in some embodiments, e.g., combinations of microwave and light cooking elements in some oven embodiments.

Figure 2:
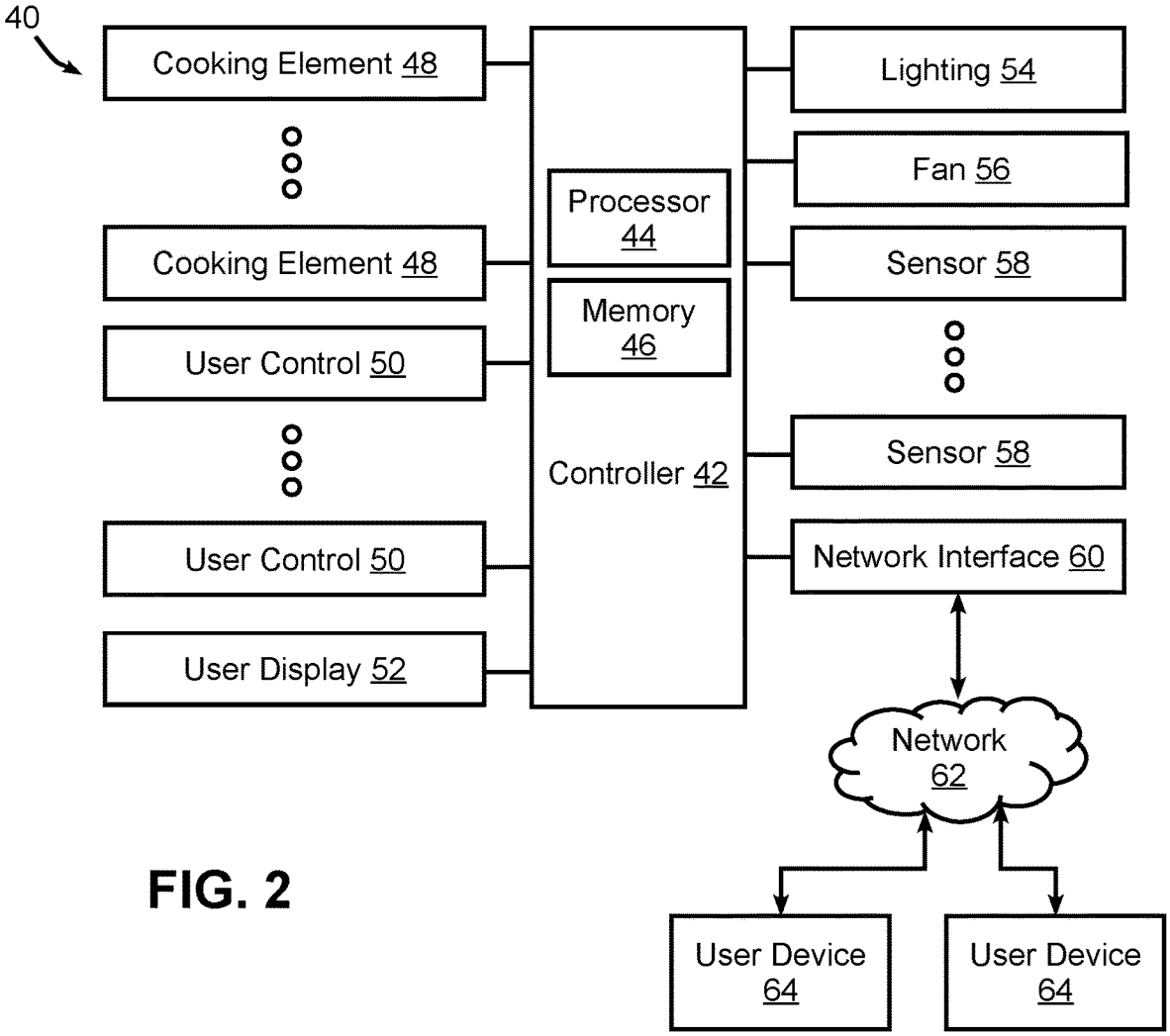
FIG. 2 is a block diagram of an example control system for a cooking appliance consistent with some embodiments of the invention.

A cooking appliance consistent with the invention also generally includes one or more controllers configured to control the cooking elements and otherwise perform cooking operations at the direction of a user. FIG. 2, for example, illustrates an example embodiment of a cooking appliance 40 including a controller 42 that receives inputs from a number of components and drives a number of components in response thereto. Controller 42 may, for example, include one or more processors 44 and a memory 46 within which may be stored program code for execution by the one or more processors. The memory may be embedded in controller 42, but may also be considered to include volatile and/or non-volatile memories, cache memories, flash memories, programmable read-only memories, read-only memories, etc., as well as memory storage physically located elsewhere from controller 42, e.g., in a mass storage device or on a remote computer interfaced with controller 42.

As shown in FIG. 2, controller 42 may be interfaced with various components, including various cooking elements 48 used for cooking food (e.g., various combinations of gas, electric, inductive, light, microwave, light cooking elements, among others), one or more user controls 50 for receiving user input (e.g., various combinations of switches, knobs, buttons, sliders, touchscreens or touch-sensitive displays, microphones or audio input devices, image capture devices, etc.), and a user display 52 (including various indicators, graphical displays, textual displays, speakers, etc.), as well as various additional components suitable for use in a cooking appliance, e.g., lighting 54 and/or one or more fans 56 (e.g., convection fans, cooling fans, etc.), among others.

Controller 42 may also be interfaced with various sensors 58 located to sense environmental conditions inside of and/or external to cooking appliance 40, e.g., one or more temperature sensors, humidity sensors, air quality sensors, smoke sensors, carbon monoxide sensors, odor sensors and/or electronic nose sensors, among others. Such sensors may be internal or external to cooking appliance 40, and may be coupled wirelessly to controller 42 in some embodiments. Sensors 58 may include, for example, one or more temperature sensors for sensing an air temperature within an oven cavity.

In some embodiments, controller 42 may also be coupled to one or more network interfaces 60, e.g., for interfacing with external devices via wired and/or wireless networks such as Ethernet, Wi-Fi, Bluetooth, NFC, cellular and other suitable networks, collectively represented in FIG. 2 at 62. Network 62 may incorporate in some embodiments a home automation network, and various communication protocols may be supported, including various types of home automation communication protocols. In other embodiments, other wireless protocols, e.g., Wi-Fi or Bluetooth, may be used. In some embodiments, cooking appliance 40 may be interfaced with one or more user devices 64 over network 62, e.g., computers, tablets, smart phones, wearable devices, etc., and through which cooking appliance 40 may be controlled and/or cooking appliance 40 may provide user feedback.

In some embodiments, controller 42 may operate under the control of an operating system and may execute or otherwise rely upon various computer software applications, components, programs, objects, modules, data structures, etc. In addition, controller 42 may also incorporate hardware logic to implement some or all of the functionality disclosed herein. Further, in some embodiments, the sequences of operations performed by controller 42 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Numerous variations and modifications to the cooking appliances illustrated in FIGS. 1-2 will be apparent to one of ordinary skill in the art, as will become apparent from the description below. Therefore, the invention is not limited to the specific implementations discussed herein.

Figure 3:
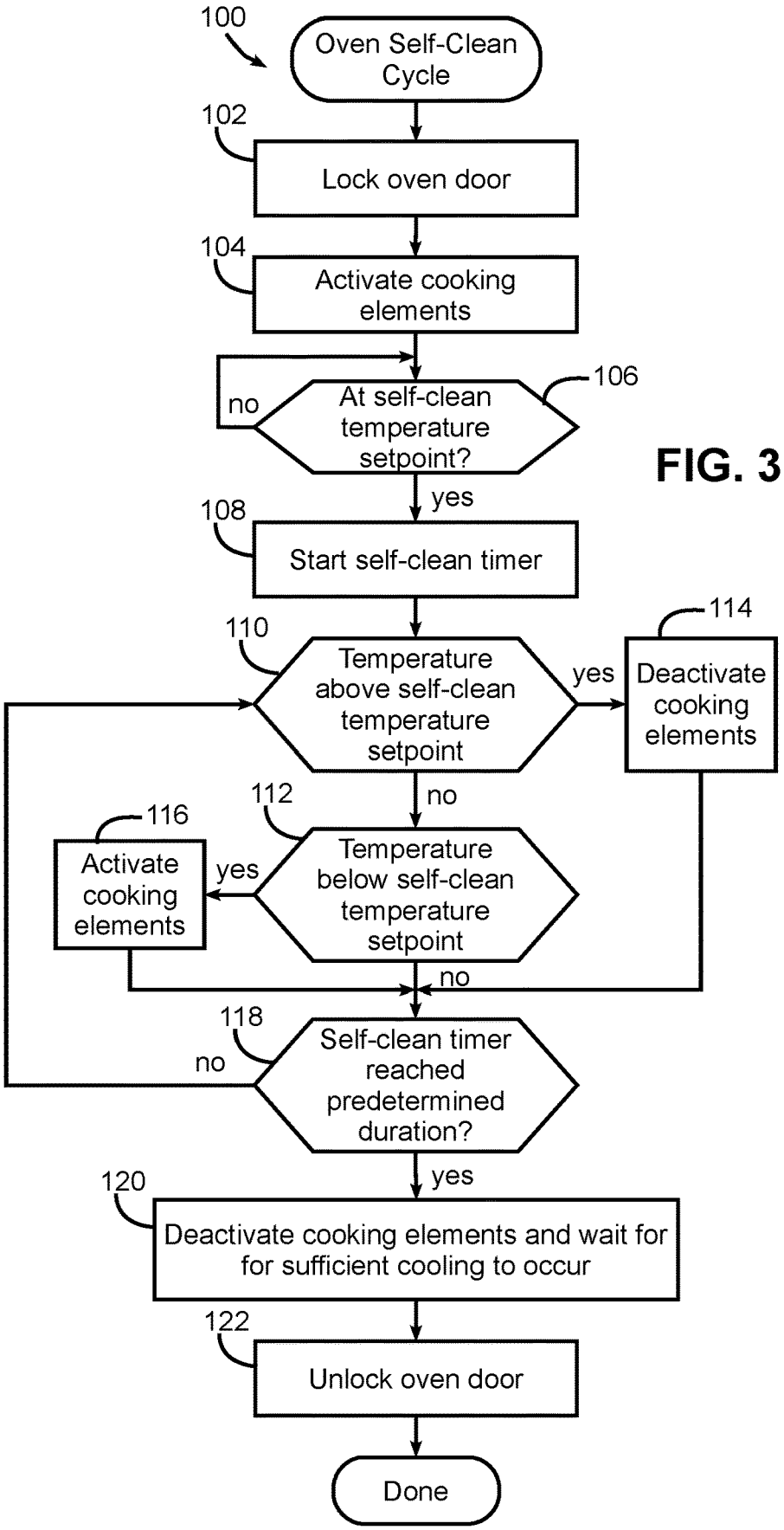
FIG. 3 is a flowchart illustrating an example sequence of operations for performing an oven self-clean cycle using the cooking appliance of FIGS. 1-2.

Now turning to FIG. 3, controller 40 of cooking appliance 10 may implement a sequence of operations 100 for an oven self-clean cycle that may be selected by a user to clean the oven. An oven self-clean cycle is generally performed at close to the maximum achievable oven temperature over a duration of multiple hours, and is generally limited by both the maximum heating energy available from the cooking elements as well as the heat losses incurred by the appliance. For example, on some cooking appliances the target self-clean temperature is around 850 degrees Fahrenheit, while the maximum achievable oven temperature is around 900 to 1000 degrees Fahrenheit. An oven self-clean cycle is generally initiated in response to user input, and may be initiated on a delayed basis in some instances. It will be appreciated that the sequence of operations discussed hereinafter is merely representative of a typical oven self-clean cycle, and has been simplified for the purposes of this disclosure. Additional operations, as well as differences in the timing and/or ordering of different operations, may vary in other oven self-clean cycles (e.g., in terms of when the timer is started, when doors are locked/unlocked, or the power level(s) delivered to the oven, etc.), so the invention is not limited to the particular sequence of operations for the oven self-clean cycle described herein.

At the start of the cycle (block 102), the oven door is locked either automatically or manually, and one or more of the cooking elements for the oven are activated (block 104), typically at maximum output power if a variable output power is supported, which initiates a preheat phase of the oven self-clean cycle. The air temperature within the oven cavity is then monitored using a temperature sensor (block 106) until the target self-clean temperature setpoint is reached. Once the temperature setpoint is reached, control then passes to block 108 to start a timer and initiate a clean phase of the cycle, and blocks 110 and 112 then monitor the air temperature to maintain the temperature within the oven cavity proximate the target self-clean temperature setpoint. Thus, for example, if the temperature rises above the self-clean temperature setpoint (which may or may not include an offset or threshold to minimize cycling), block 110 passes control to block 114 to deactivate the cooking elements. Likewise, if the temperature falls below the self-clean temperature setpoint (which may or may not include an offset or threshold to minimize cycling), block 112 passes control to block 116 to deactivate the cooking elements. As such, the controller maintains the temperature within the oven cavity within a narrow range around the target self-clean temperature setpoint.

Block 118 then periodically checks if the self-clean timer has reached a predetermined duration for the clean phase (e.g., generally in the range of about 1 to about 5 hours), and if not, returns control to block 110 to continue to regulate or control the cooking elements to maintain the oven cavity temperature proximate the target self-clean temperature setpoint. If the duration has been reached, however, block 118 passes control to block 120 to initiate a cooling phase by deactivating the cooking elements and waiting for sufficient cooling to occur (e.g., after a predetermined duration or after the oven cavity temperature falls below a predetermined threshold). The oven door is then unlocked (block 122), and the oven self-clean cycle is complete.

The preheat phase of an oven self-clean cycle generally follows an asymptotic formula when a constant heat source (e.g., one or more cooking elements outputting at a constant power level) is used to preheat the oven cavity. The asymptotic formula is of the general form $\Delta T=A(1-e^{-Bt})$, where $\Delta T$ is the change in oven temperature, A is the asymptotic limit (i.e., the maximum possible oven temperature), e is the natural logarithm base, B is a time constant, and t is time. Conventional oven controls, both mechanical and electrical, generally will allow the oven to heat until the oven temperature exceeds the target self-clean temperature setpoint, and thereafter regulate or modulate the heat source such that the oven temperature cycles around the target self-clean temperature setpoint rather than continuing to increase towards the asymptotic limit.

Figure 4:
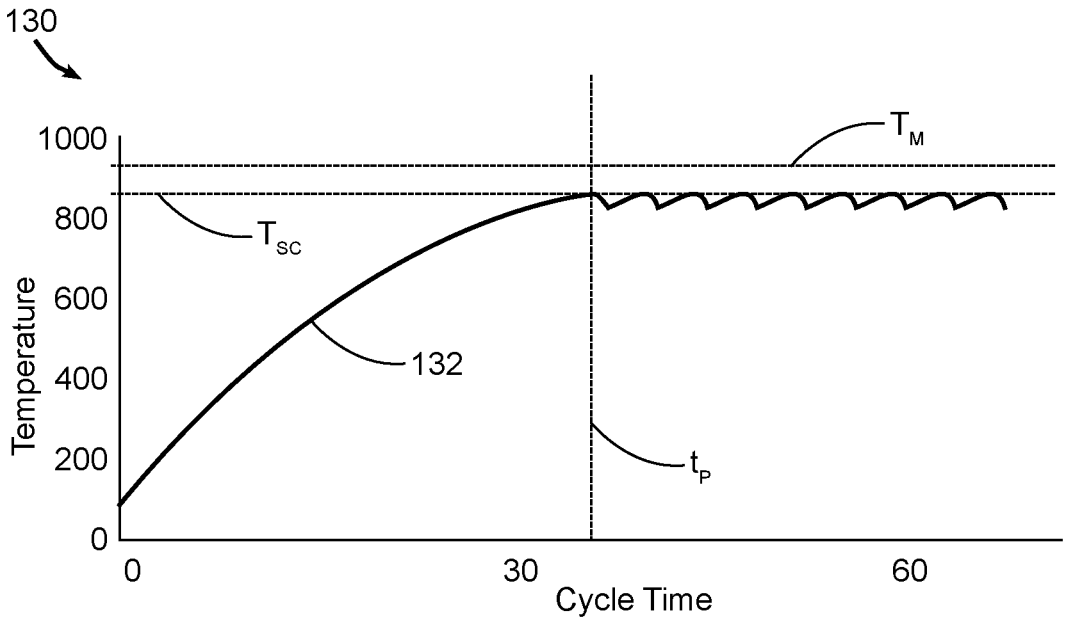
FIG. 4 is a graph of an example time-temperature curve for an example cooking appliance.

FIG. 4, as an example, illustrates a graph 130 of a time-temperature curve 132 for an example cooking appliance. Due to the high temperatures experienced during self-clean, limitations in available heating power, and limitations in minimizing heat losses, the asymptotic limit or maximum temperature ($T_M$) is often very close to the self-clean temperature setpoint ($T_{SC}$) around which the oven temperature cycles, as self-cleaning performance is generally proportional to temperature. This means that as the oven temperature approaches $T_{SC}$, the rate of temperature rise decreases. As a result, a very small change in the overall system may result in a very large change in time difference when the target self-clean temperature setpoint is reached (designated as line $t_P$, representing the preheat time or duration). It has been found, for example, that even within standard manufacturing variations in electric cooking element wattages, two otherwise identical appliances can have variations in $t_P$ of 10 minutes or more.

These variations, however, can complicate certification testing of cooking appliances. Within the United States, for example, the regulatory standard for household cooking ranges is UL 858 published by Underwriter's Laboratories. Similarly, CSA (Canadian Standards Association) publishes the regulatory standard C22.2 No. 61-16 for household cooking ranges sold in Canada. In the course of certification, certain tests may be waived should the product being evaluated be constructed and operate in a manner similar to an existing certified product, and the similarity of operation between a previously certified product and a product being tested under both standards is generally established by comparing the time-temperature curves of the two products.

In particular, products are deemed essentially equivalent should the following conditions be met: (1) the peak maximum oven cavity air temperature differs from the original test value by no more than ±5 percent; (2) the rise time from room temperature to 454° C. (850° F.) or the maximum oven cavity air temperature (whichever is lower) changes by no more than +15/−7 minutes (referred to herein as a primary duration); and (3) the rise time from 316° C. (600° F.) to 454° C. (850° F.) or the maximum oven cavity air temperature (whichever is lower) changes by no more than +10/−7 minutes (referred to herein as a secondary duration). For reference, see UL858 (Ed. 16) section 100.5 and CSA C22.2 No. 61-16 section 7.26.1.5. Of note, for convenience the higher temperature referenced above, 454° C. (850° F.) or the maximum oven cavity air temperature, is also referred to herein as a first test waiver target temperature, while the lower temperature referenced above, 316° C. (600° F.), is also referred to herein as a second test waiver target temperature.

Figure 5:
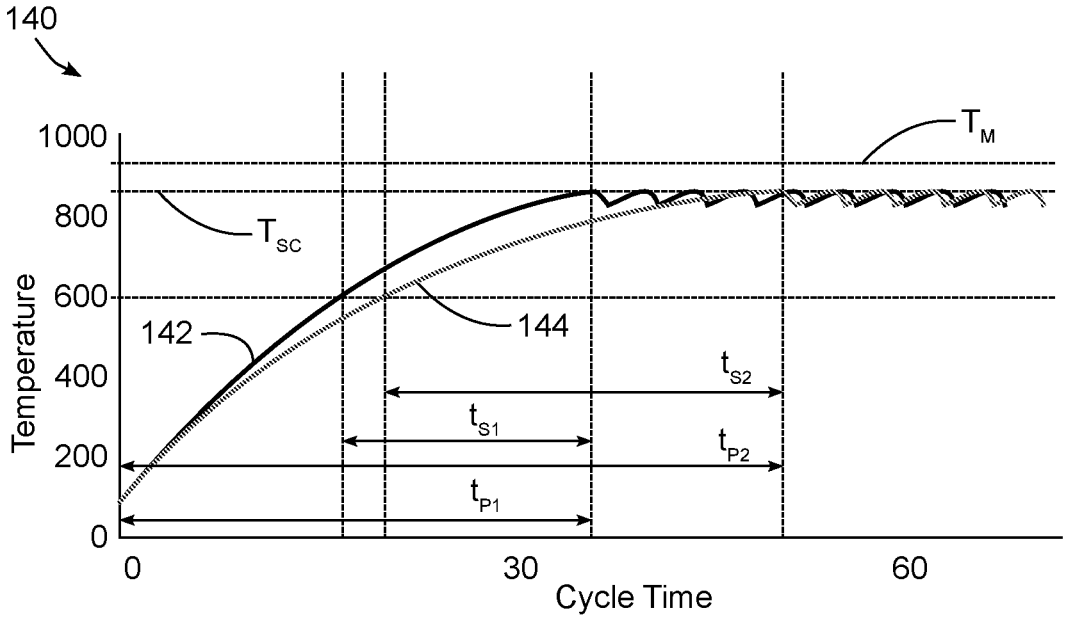
FIG. 5 is a graph of two example time-temperature curves for two example cooking appliances, and identifies primary and secondary durations for each cooking appliance.

As discussed above, two cooking appliances with the same construction and same control may fail the time-temperature curve comparison simply as a result of unit-to-unit variation in construction or components (e.g., variations in heating element wattage, among other components). FIG. 5, for example, illustrates a graph 140 of two time-temperature curves 142, 144 for two example cooking appliances $A_1$ and $A_2$, which are constructed in a similar manner and using the same control, with an assumption that cooking appliance $A_2$ has a lower wattage cooking element than cooking appliance $A_1$. It is also assumed that the target self-clean temperature setpoint for each cooking appliance is 850° F. It will be appreciated that despite similar curves, cooking appliance $A_2$ takes substantially longer to reach the target self-clean temperature setpoint from room temperature (a primary duration labeled as $t_{P2}$) than cooking appliance $A_1$ (a primary duration labeled as of $t_{P1}$). Similarly, cooking appliance $A_2$ also takes longer to reach the target self-clean temperature setpoint from 316° C. (600° F.) (a secondary duration labeled as $t_{S2}$) than cooking appliance $A_1$ (a secondary duration labeled as of $t_{S1}$).

An inability to establish that a product being evaluated is constructed and operates in a manner similar to an existing certified product can result in additional testing requirements on appliance manufacturers, so a need exists for addressing the effects of the aforementioned variabilities in cooking appliances due to component and appliance manufacturing variances and other factors.

In embodiments consistent with the invention, these effects are addressed by employing a staged oven self-clean preheat temperature control that controls one or more cooking elements of a cooking appliance during a preheat phase of an oven self-clean cycle using multiple stages. The multiple stages are defined by utilizing one or more intermediate temperature setpoints that are below a self-clean temperature setpoint for the oven self-clean cycle, and that are each associated with a predetermined time or duration in an oven self-clean cycle, such that transitions from one stage to another stage do not occur until the predetermined time or duration for a given stage has been reached. As such, at each stage the temperature rise is effectively "paused" until the predetermined time or duration is reached. By doing so, the time-temperature curve of a cooking appliance may be more carefully controlled, e.g., to provide a substantially consistent time-temperature curve that is more resistant to manufacturing variations in cooking elements and the like.

As an example, and as noted above, according to the UL and CSA standards, the characteristics that are utilized to determine the similarity of two time-temperature curves are the time from the beginning to the first peak of cycling at the self-clean target temperature setpoint (a duration designated herein as $t_P$) and from 600° F. to the first peak of cycling at the self-clean target temperature (a duration designated herein as $t_S$). In order to minimize variation at these points, a controller may, in each of one or more stages, pause the temperature rise at a predetermined temperature setpoint that is below the temperatures associated with these points until a specified time has elapsed. Therefore, in a first stage, a controller may control cooking elements to heat from room temperature to a temperature setpoint that is just below 600° F. At this point, the controller may maintain the oven temperature below 600° F. until a specified time has elapsed. Then, once the allotted time has passed, the controller may control the cooking elements to heat the oven beyond 600° F. In this way, the time at which the oven temperature crosses the 600° F. threshold is controlled almost entirely by the time setting and has very little dependence on the output of the cooking elements or other variations, thus effectively eliminating cooking element output as a predominant source of variation in the time taken to reach 600° F.

Likewise, in a second stage, the controller may control the cooking elements to heat the oven from 600° F. to just below the target self-clean temperature setpoint (e.g., 850° F., although the invention is not so limited). Again, the controller may maintain the oven temperature below the target self-clean temperature setpoint until another specified time has elapsed. After the allotted time has passed, the controller may then control the cooking elements to continue to increase the oven temperature until it reaches the target self-clean temperature setpoint. As in the first stage, this enables the time at which the oven temperature reaches the target self-clean temperature setpoint to be controlled almost entirely by the time setting and with little dependence on the output of the cooking elements or other variations, thus effectively eliminating cooking element output as a predominant source of variation in the time taken to reach the target self-clean temperature setpoint.

Figure 6A:
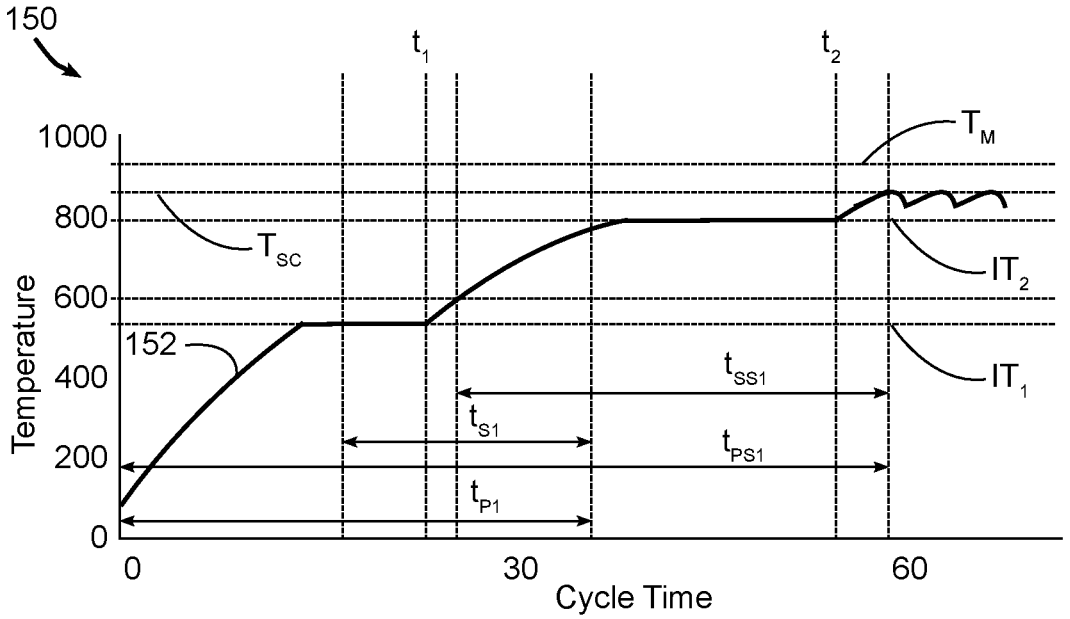
FIGS. 6A and 6B illustrate two controlled time-temperature curves for the two example cooking appliances represented in FIG. 5, and generated using an oven self-clean preheat temperature control consistent with some embodiments of the invention.
Figure 6B:
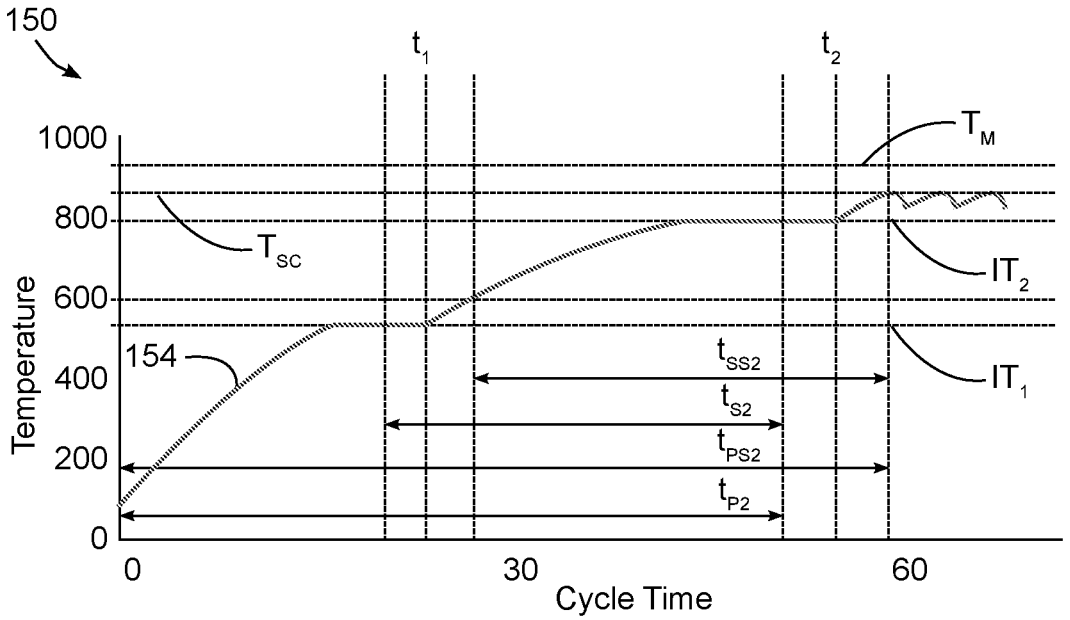

As an illustration of this concept, FIGS. 6A and 6B illustrate a graph 150 of controlled time-temperature curves 152 (FIG. 6A) and 154 (FIG. 6B) for the two example cooking appliances $A_1$ and $A_2$ discussed above in connection with FIG. 5, generated using the herein described staged oven self-clean preheat temperature control. For the purposes of simplifying the figures, cycling of the cooking elements while held at constant temperature setpoints is not illustrated, although it will be appreciated that such cycling may be used in some embodiments.

The staged oven self-clean preheat temperature control used to generate curves 152, 154 is based upon two stages of operation. In a first stage, a first intermediate temperature setpoint $IT_1$ is set for a temperature that is slightly (e.g., about 25 to about 50 degrees) below the 600° F. threshold discussed above. The first intermediate temperature setpoint $IT_1$ is associated with a first predetermined time $t_1$, which is selected to be after the time it would take for each of cooking appliances $A_1$ and $A_2$ (or any other cooking appliances for which similarity in operation might be sought) to reach the 600° F. threshold from room temperature such that, irrespective of variances in the output power of the cooking elements of any cooking appliances for which similarity in operation may be sought, the cooking appliances will reach the first intermediate temperature setpoint and be held at that temperature for some period of time. Then, once the predetermined time $t_1$ is reached, heating will resume, resulting in the variance in the times at which the various cooking appliances reach the 600° F. threshold being substantially reduced.

In a second stage, a second intermediate temperature setpoint $IT_2$ is set for a temperature that is slightly (e.g., about 25 to about 50 degrees) below the target self-clean temperature setpoint of 850° F. discussed above. The second intermediate temperature setpoint $IT_2$ is associated with a second predetermined time t2, which is selected to be after the time it would take for each of cooking appliances $A_1$ and $A_2$ (or any other cooking appliances for which similarity in operation might be sought) to reach the target self-clean temperature setpoint when starting from the first intermediate temperature setpoint $IT_1$ such that, irrespective of variances in the output power of the cooking elements of any cooking appliances for which similarity in operation may be sought, the cooking appliances will reach the second intermediate temperature setpoint and be held at that temperature for some period of time. Then, once the predetermined time t2 is reached, heating will resume, resulting in the variance in the times at which the various cooking appliances reach the target self-clean temperature setpoint being substantially reduced.

It will be appreciated that by pausing the temperature rise at one or more stages, the variances between different cooking appliances may be reduced. For the cooking appliance $A_1$, the primary duration for the staged control (room temperature to target self-clean temperature setpoint) illustrated in FIG. 6A is labeled $t_{PS1}$ and the second duration (600° F. to target self-clean temperature setpoint) is labeled $t_{SS1}$. Similarly, for the cooking appliance $A_2$, the primary duration for the staged control (room temperature to target self-clean temperature setpoint) illustrated in FIG. 6B is labeled $t_{PS2}$ and the second duration (600° F. to target self-clean temperature setpoint) is labeled $t_{SS2}$. From a review of FIGS. 6A and 6B, it will be appreciated that while $t_{PS1}$, $t_{PS2}$, $t_{SS1}$ and $t_{SS2}$ are respectively longer than the respective durations $t_{P1}$, $t_{P2}$, $t_{S1}$ and $t_{S2}$, the difference between $t_{PS1}$ and $t_{PS2}$ for the staged control is less than the difference between $t_{P1}$ and $t_{P2}$, and the difference between $t_{SS1}$ and $t_{SS2}$ for the staged control is less than the difference between $t_{S1}$ and $t_{S2}$.

Figure 7:
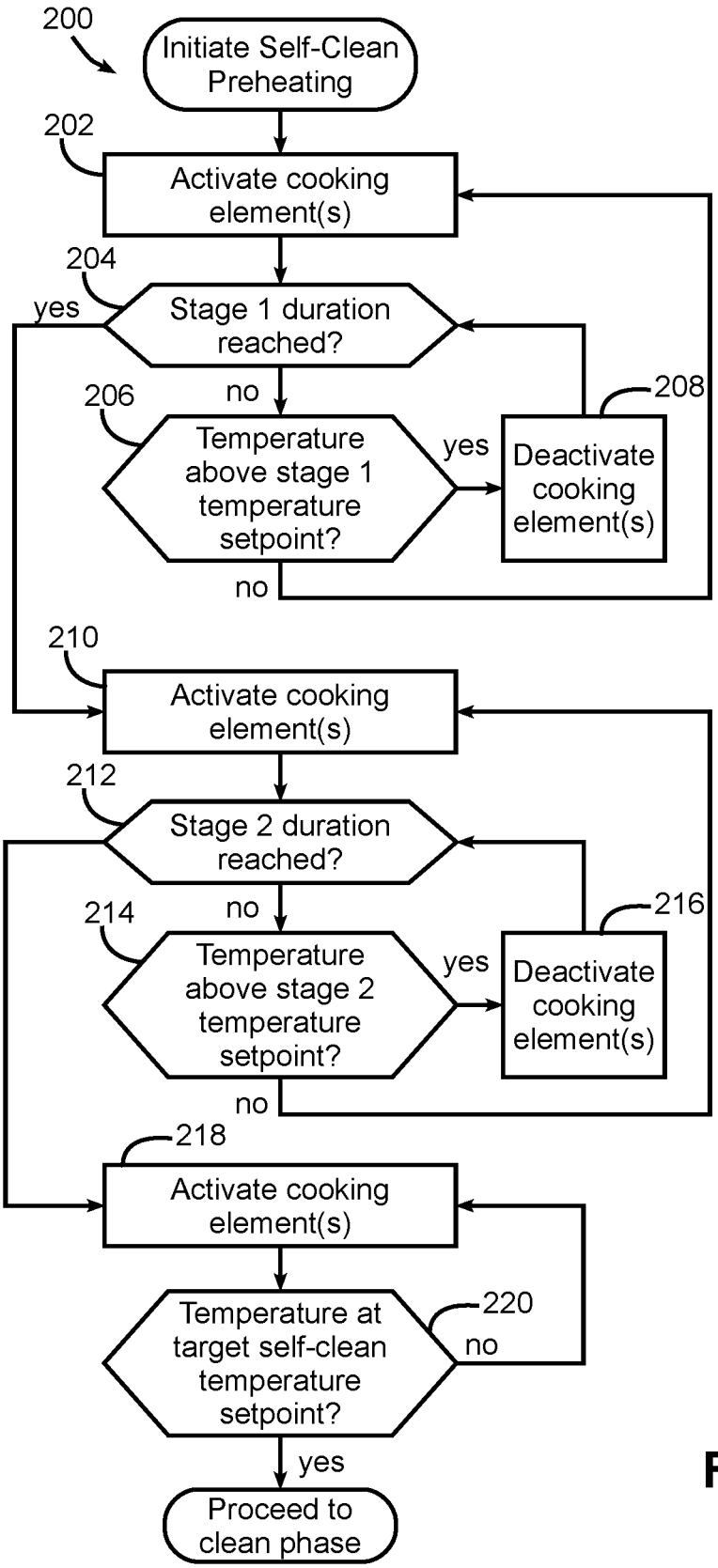
FIG. 7 is a flowchart illustrating an example sequence of operations for performing an oven self-clean cycle preheat phase using the cooking appliance of FIGS. 1-2.

FIG. 7 illustrates an example sequence of operations 200 capable of being executed by controller 40 of appliance 10 to perform a self-clean preheat phase during an oven self-clean cycle, and utilizing a staged oven self-clean preheat temperature control as described herein. In this embodiment, three preheat stages are used, the first having a first intermediate temperature setpoint selected to be slightly below the 600° F. threshold utilized in US and Canadian testing and a first predetermined time or duration selected to provide sufficient time for any cooking appliance desired to be treated as operating in a similar fashion for the purposes of testing to reach the first intermediate temperature setpoint, the second having an intermediate temperature setpoint selected to be slightly below the target self-clean temperature setpoint to be used during the clean phase of the oven self-clean cycle and a second predetermined time or duration selected to provide sufficient time for any cooking appliance desired to be treated as operating in a similar fashion for the purposes of testing to reach the second intermediate temperature setpoint. The third stage is used to increase the oven cavity temperature to the target self-clean temperature setpoint.

Block 202 initiates the first preheat stage by activating one or more cooking elements to cause the oven cavity temperature to increase. When using constant output electric cooking elements, for example, block 202 may set the cooking elements to an active state. Block 204 determines if the first stage time or duration has been reached, and if not, passes control to block 206 to determine if the current oven temperature (e.g., as sensed by a temperature sensor) is above the first intermediate temperature setpoint for the first stage. If not, control returns to block 202. Otherwise, control passes to block 208 to deactivate the one or more cooking elements to allow the oven cavity temperature to stabilize and be maintained proximate the first intermediate temperature setpoint. When using constant output electric cooking elements, for example, block 208 may set the cooking elements to an inactive state. Control then returns to block 204, and as such, blocks 202-208 effectively cause the oven cavity temperature to rise from room temperature to the first intermediate temperature setpoint and be held there until the first predetermined time or duration has been reached.

Once the first predetermined time or duration has been reached, however, block 204 passes control to block 210 to initiate the second preheat stage by activating the one or more cooking elements to cause the oven cavity temperature to once again increase. Block 212 determines if the second stage time or duration has been reached, and if not, passes control to block 214 to determine if the current oven temperature (e.g., as sensed by a temperature sensor) is above the second intermediate temperature setpoint for the second stage. If not, control returns to block 210. Otherwise, control passes to block 216 to deactivate the one or more cooking elements to allow the oven cavity temperature to stabilize and be maintained proximate the second intermediate temperature setpoint. Control then returns to block 212, and as such, blocks 210-216 effectively cause the oven cavity temperature to rise from the first intermediate temperature setpoint, past the 600° F. threshold, and to the second intermediate temperature setpoint and be held there until the second predetermined time or duration has been reached.

Once the second predetermined time or duration has been reached, however, block 212 passes control to block 218 to proceed to the third preheat stage and activate the one or more cooking elements to cause the oven cavity temperature to once again increase. Control then passes to block 220 to determine if the oven cavity temperature has reached the target self-clean temperature setpoint. If not, control returns to block 218; however, once the target self-clean temperature setpoint has been reached, the preheat phase is complete, and the oven self-clean cycle may proceed to the clean phase (e.g., to perform the operations discussed above in connection with blocks 108-122 of FIG. 3).

Various modifications may be made to the illustrated embodiments without departing from the spirit and scope of the invention. For example, while the illustrated embodiments predominantly focus on electric ovens and ranges utilizing electric cooking elements, the herein-described techniques may also be utilized in connection with other cooking technologies, e.g., gas ranges and ovens, or in ranges and ovens utilizing a combination of gas and electric cooking elements. In addition, rather than cycling using constant output cooking elements as is the case with some of the embodiments discussed above, cooking element wattage or burner ratings, cooking element power levels (in the case of variable output cooking elements), the selection of cooking elements (e.g., bake, broil and/or convection cooking elements), and/or the duty cycling of those cooking elements may be varied to increase/decrease the rate of oven temperature rise during the preheat phase of an oven self-clean cycle when utilizing a staged oven self-clean preheat temperature control.

Furthermore, it will be appreciated that greater or fewer numbers of stages, intermediate temperature setpoints and/or predetermined times may be used in other embodiments. For example, if a particular standard is based only on a single duration (rather than the multiple durations in the aforementioned standards), a single intermediate temperature setpoint and predetermined time may be used to enable different appliances to reach a desired temperature with a reduced variance between the duration required to do so. In addition, while a target self-clean temperature setpoint of 850° F. has been discussed herein, it will be appreciated that the invention is not so limited, and control of the preheat phase of an oven self-clean cycle using the techniques described herein may use other setpoints while still reducing variances in time-temperature curves between different cooking appliances.

It will therefore be appreciated that by controlling the transition between each stage of a preheat phase of an oven self-clean cycle according to time, rather than controlling by temperature alone, allows for greater control of the time-temperature characteristics of an oven self-clean cycle, often allowing for a reduction in the required testing for certification.

It will be appreciated that various modifications may be made to the embodiments discussed herein, and that a number of the concepts disclosed herein may be used in combination with one another or may be used separately. Therefore, the invention lies in the claims hereinafter appended.

What is claimed is:

1. A cooking appliance, comprising:

a housing including an oven cavity;

a temperature sensor configured to sense an air temperature within the oven cavity;

one or more electric cooking elements configured to generate heat within the oven cavity; and a controller in communication with the temperature sensor and configured to control the one or more electric cooking elements to perform an oven self-clean cycle within the oven cavity, wherein the controller is configured to perform the oven self-clean cycle by regulating the one or more electric cooking elements to maintain the temperature within the oven cavity proximate a self-clean temperature setpoint, and wherein the controller is further configured to perform the oven self-clean cycle by, during a preheat phase of the oven self-clean cycle:

regulating the one or more cooking elements to increase the air temperature within the oven cavity to a first intermediate temperature setpoint that is below about 316° C. (about 600° F.);

thereafter regulating the one or more electric cooking elements to maintain the air temperature within the oven cavity proximate the first intermediate temperature setpoint until reaching a first predetermined time such that when the first intermediate temperature setpoint is reached prior to reaching the first predetermined time, the controller regulates the one or more electric cooking elements to pause a further temperature rise in the oven cavity until the first predetermined time is reached;

thereafter regulating the one or more cooking elements to increase the air temperature within the oven cavity to a second intermediate temperature setpoint that is above about 316° C. (about 600° F.) and below about 454° C. (about 850° F.);

thereafter regulating the one or more electric cooking elements to maintain the air temperature within the oven cavity proximate the second intermediate temperature setpoint until reaching a second predetermined time such that when the second intermediate temperature setpoint is reached prior to reaching the second predetermined time, the controller regulates the one or more electric cooking elements to pause a further temperature rise in the oven cavity until the second predetermined time is reached; and thereafter regulating the one or more cooking elements to increase the air temperature within the oven cavity to the self-clean temperature setpoint;

wherein the controller regulates the one or more electric cooking elements to provide a controlled rise time to the self-clean temperature setpoint that is substantially independent of any variance in output power of the one or more electric cooking elements.

2. A cooking appliance, comprising:

a housing including an oven cavity;

a temperature sensor configured to sense a temperature within the oven cavity;

one or more cooking elements configured to generate heat within the oven cavity; and a controller in communication with the temperature sensor and configured to control the one or more cooking elements to perform an oven self-clean cycle within the oven cavity, wherein the controller is configured to perform the oven self-clean cycle by regulating the one or more cooking elements to maintain the temperature within the oven cavity proximate a self-clean temperature setpoint, and wherein the controller is further configured to perform the oven self-clean cycle by, during a preheat phase of the oven self-clean cycle, regulating the one or more cooking elements to maintain the temperature within the oven cavity proximate an intermediate temperature setpoint that is below the self-clean temperature setpoint until reaching a predetermined time in the oven self-clean cycle, such that when the intermediate temperature setpoint is reached prior to reaching the predetermined time, the controller regulates the one or more cooking elements to pause a further temperature rise in the oven cavity until the predetermined time is reached.

3. The cooking appliance of claim 2, wherein the controller is further configured to, after reaching the predetermined time, regulate the one or more cooking elements to increase the temperature within the oven cavity to the self-clean temperature setpoint and initiate a clean phase of the oven self-clean cycle.

4. The cooking appliance of claim 2, wherein the intermediate temperature setpoint is a first intermediate temperature setpoint and the predetermined time is a first predetermined time, and wherein the controller is further configured to, after reaching the first predetermined time, regulate the one or more cooking elements to maintain the temperature within the oven cavity proximate a second intermediate temperature setpoint that is above the first intermediate temperature setpoint and below the self-clean temperature setpoint until reaching a second predetermined time in the oven self-clean cycle such that when the second intermediate temperature setpoint is reached prior to reaching the second predetermined time, the controller regulates the one or more cooking elements to pause a further temperature rise in the oven cavity until the second predetermined time is reached.

5. The cooking appliance of claim 4, wherein the self-clean temperature setpoint is about 454° C. (about 850° F.) and the second intermediate temperature setpoint is about 25° F. to about 50° F. below the self-clean temperature setpoint.

6. The cooking appliance of claim 4, wherein the controller is configured to control the one or more cooking elements during the preheat phase to provide a controlled rise time from the second intermediate temperature setpoint to the self-clean temperature setpoint that is substantially independent of any variance in output power of the one or more cooking elements.

7. The cooking appliance of claim 4, wherein the first intermediate temperature setpoint is below a third intermediate temperature setpoint that is below the self-clean temperature setpoint and below the second intermediate temperature setpoint, wherein the controller is further configured to control the one or more cooking elements during the preheat phase to provide a controlled rise time from room temperature to the third intermediate temperature setpoint that is substantially independent of any variance in output power of the one or more cooking elements.

8. The cooking appliance of claim 7, wherein the third intermediate temperature setpoint is about 316° C. (about 600° F.) and the first intermediate temperature setpoint is about 25° F. to about 50° F. below the third intermediate temperature setpoint.

9. The cooking appliance of claim 2, wherein the controller is configured to regulate the one or more cooking elements during the preheat phase to increase the temperature within the oven cavity to the intermediate temperature setpoint prior to maintaining the temperature within the oven cavity proximate the intermediate temperature setpoint and prior to reaching the predetermined time in the oven self-clean cycle.

10. The cooking appliance of claim 2, wherein the one or more cooking elements includes one or more electric cooking elements, and wherein the controller is configured to regulate the one or more cooking elements to maintain the temperature within the oven cavity proximate the intermediate temperature setpoint by cycling the one or more electric cooking elements between active and inactive states.

11. A method of controlling a cooking appliance, the method comprising:

sensing a temperature within an oven cavity of a cooking appliance;

with a controller in communication with the temperature sensor, performing an oven self-clean cycle within the oven cavity by regulating one or more cooking elements that generate heat within the oven cavity to maintain the temperature within the oven cavity proximate a self-clean temperature setpoint; and with the controller and during a preheat phase of the oven self-clean cycle, regulating the one or more cooking elements to maintain the temperature within the oven cavity proximate an intermediate temperature setpoint that is below the self-clean temperature setpoint until reaching a predetermined time in the oven self-clean cycle, such that when the intermediate temperature setpoint is reached prior to reaching the predetermined time, the controller regulates the one or more cooking elements to pause a further temperature rise in the oven cavity until the predetermined time is reached.

12. The method of claim 11, further comprising, after reaching the predetermined time, regulating the one or more cooking elements to increase the temperature within the oven cavity to the self-clean temperature setpoint and initiating a clean phase of the oven self-clean cycle.

13. The method of claim 11, wherein the intermediate temperature setpoint is a first intermediate temperature setpoint and the predetermined time is a first predetermined time, and wherein the method further comprises, after reaching the first predetermined time, regulating the one or more cooking elements to maintain the temperature within the oven cavity proximate a second intermediate temperature setpoint that is above the first intermediate temperature setpoint and below the self-clean temperature setpoint until reaching a second predetermined time in the oven self-clean cycle such that when the second intermediate temperature setpoint is reached prior to reaching the second predetermined time, the controller regulates the one or more cooking elements to pause a further temperature rise in the oven cavity until the second predetermined time is reached.

14. The method of claim 13, wherein the self-clean temperature setpoint is about 454° C. (about 850° F.) and the second intermediate temperature setpoint is about 25° F. to about 50° F. below the self-clean temperature setpoint.

15. The method of claim 13, further comprising controlling the one or more cooking elements during the preheat phase to provide a controlled rise time from the second intermediate temperature setpoint to the self-clean temperature setpoint that is substantially independent of any variance in output power of the one or more cooking elements.

16. The method of claim 13, wherein the first intermediate temperature setpoint is below a third intermediate temperature setpoint that is below the self-clean temperature setpoint and below the second intermediate temperature setpoint, the method further comprising controlling the one or more cooking elements during the preheat phase to provide a controlled rise time from room temperature to the third intermediate temperature setpoint that is substantially independent of any variance in output power of the one or more cooking elements.

17. The method of claim 14, wherein the third intermediate temperature setpoint is about 316° C. (about 600° F.) and the first intermediate temperature setpoint is about 25° F. to about 50° F. below the third intermediate temperature setpoint.

18. The method of claim 11, further comprising regulating the one or more cooking elements during the preheat phase to increase the temperature within the oven cavity to the intermediate temperature setpoint prior to maintaining the temperature within the oven cavity proximate the intermediate temperature setpoint and prior to reaching the predetermined time in the oven self-clean cycle.

19. The method of claim 11, wherein the one or more cooking elements includes one or more electric cooking elements, and wherein regulating the one or more cooking elements to maintain the temperature within the oven cavity proximate the intermediate temperature setpoint includes cycling the one or more electric cooking elements between active and inactive states.

* * * * *